United States Patent [19]

Toyoda

[11] Patent Number: 4,751,050

[45] Date of Patent: Jun. 14, 1988

[54] SUBSTRATE FOR MAGNETIC RECORDING MEDIA

[75] Inventor: Atsushi Toyoda, Hamamatsu, Japan

[73] Assignee: Nippon Gakki Seizo Kabushiki Kaisha, Japan

[21] Appl. No.: 927,814

[22] Filed: Nov. 6, 1986

[30] Foreign Application Priority Data

Nov. 8, 1985 [JP] Japan ..... 60-250440

[51] Int. Cl.[4] ..... C22C 21/06

[52] U.S. Cl. ..... 420/541; 420/540; 428/653

[58] Field of Search ..... 420/540, 541, 542; 428/653

[56] References Cited

FOREIGN PATENT DOCUMENTS

| | | | |
|---|---|---|---|
| 972684 | 9/1959 | Fed. Rep. of Germany | 420/541 |
| 1109903 | 6/1961 | Fed. Rep. of Germany | 420/541 |
| 17414 | 6/1978 | Japan | 420/542 |
| 35849 | 9/1978 | Japan | 420/542 |
| 107816 | 8/1979 | Japan | 420/542 |
| 33448 | 4/1981 | Japan | 420/541 |
| 205444 | 11/1984 | Japan | 420/540 |
| 262936 | 12/1985 | Japan | 420/542 |

*Primary Examiner*—L. Dewayne Rutledge
*Assistant Examiner*—Robert L. McDowell
*Attorney, Agent, or Firm*—Lerner, David, Littenberg, Krumholz & Mentlik

[57] ABSTRACT

In composition of an Al-base substrate for magnetic recording media, additional inclusion of at least one of specified amount of Cr, Mg and Zn greatly improves recording and reproducing function of the product.

4 Claims, 2 Drawing Sheets

SUBSTRATE FOR MAGNETIC RECORDING MEDIA

BACKGROUND OF THE INVENTION

The present invention relates to an improved substrate for magnetic recording media, and more particularly relates to an improvement of a substrate used as a base material for magnetic recording media such as fixed magnetic disc recording devices.

It is conventionally employed to produce a magnetic recording medium by subjecting an Al or Al-base alloy substrate to anode oxidization to form an anode oxidized film thereon and depositing magnetic substance in pores in the anode oxidized film through precipitation.

To this end, 99.99% high purity Al or Al-base alloy including 3.5 to 4.5% by weight of reinforcing Mg is mainly used. This is mainly because other elements included in such Al or Al-base alloy do not form the anode oxidized film.

At deposition of the magnetic substance on such a substrate, there is unavoidable fluctuation in amount of the magnetic substance deposited in the pores in the anode oxidized film. This is because poor orientation of Al or Al-base alloy crystal in the substrate seriously hinders production of uniform barrier layers in the pores and resulting fluctuation in electric characteristics of the barrier layers induces corresponding fluctuation in rate and amount of deposition of the magnetic substance in the film pores.

SUMMARY OF THE INVENTION

It is the object of the present invention to eliminate the above-described fluctuation in rate and amount of magnetic substance deposition in the film pores.

In accordance with the present invention, high purity Al or Al-base alloy includes one of 0.03 to 0.05% by weight of Cr, and 0.03 to 0.05% by weight of Cr combined with 0.001 to 0.002% by weight of Zn.

DESCRIPTION OF THE PREFERRED EMBODIMENT

Figure 1:
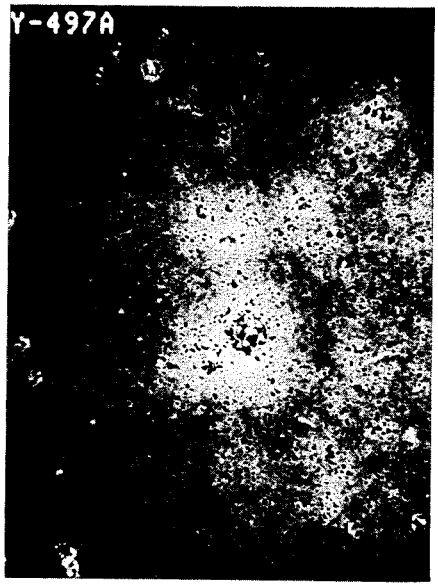
FIGS. 1 to 3 are microscopic representations of the state of precipitation of magnetic material on substrates produced in some examples.

In one preferred embodiment of the present invention, the substrate includes 0.03 to 0.05% by weight of Cr or 0.03 to 0.05% by weight of Cr combined with 0.001 to 0.002% by weight of Zn. The substrate may further include 3.5 to 4.5% by weight of Mg.

Inclusion of Cr assures uniform conductive characteristics of the barrier layer. Any degree of inclusion below 0.03% by weight would not assure this effect whereas any degree of inclusion beyond 0.05% by weight would cause undesirable production of intermetallic compounds.

Inclusion of Zn further raises the above-described effect when its degree exceeds 0.001% by weight. Any degree of inclusion above 0.002% by weight would again produce intermetallic compound.

EXAMPLES

Three circular substrates of the following compositions were prepared.

(A)

Mg 4.00% by weight
Cr 0.04% by weight
Zn 0.001% by weight
Al in balance (B)

Mg 4.00% by weight
Cr 0.04% by weight
Al in balance (C)

Mg 4.00% by weight
Al in balance

The three substrates were subjected to anode oxidization under the following conditions (I). Next, magnetic material, i.e. Fe was deposited in pores in the anode oxidized films under the following conditions (II).

| | | |
|---|---|---|
| (I) | Anode oxidization | |
| | Temperature | 5~30° C. |
| | Voltage | 35~50 V |
| | Current | DC |
| | Stirring | $N_2$ gas blowing |
| | Bath | 3% oxalic acid solution |
| | Time | 10 min. |
| (II) | Electrolysis | |
| | Temperature | 20~50° C. |
| | Voltage | 10~20 V |
| | Current | AC |
| | Bath | ferrous sulfide 80 g/l, boric acid 30 g/l |
| | Time | 20 min |

Figure 2:
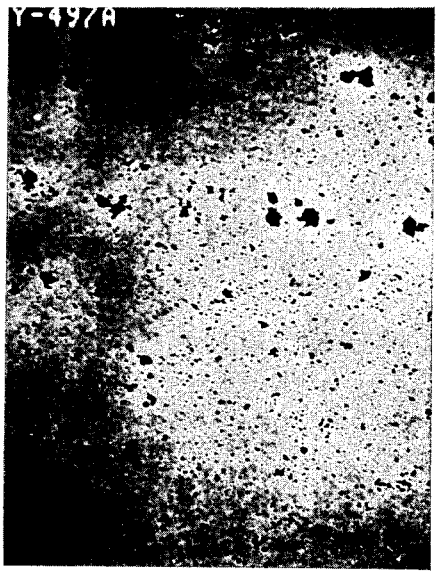
Figure 3:
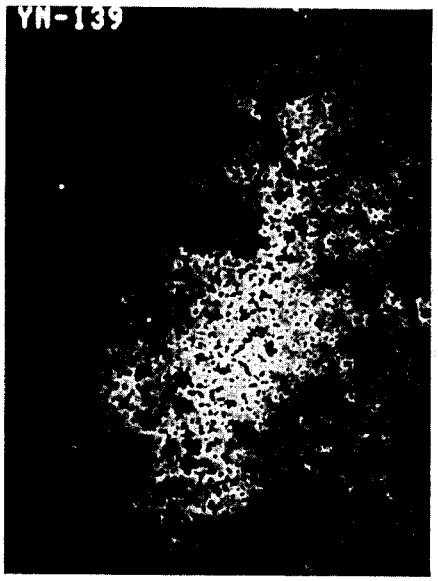

The obtained three magnetic recording media were subjected to electronic-microscopic inspection in order to know the state of precipitation of the magnetic material and the microscopic representations are shown in FIGS. 1 to 3.

FIG. 1 shows the state of magnetic material precipitated on the magnetic recording medium starting from the substrate of the composition (A). Fine black points indicate deposited Fe. Uniform deposition of Fe is well observed.

FIG. 2 shows the state of magnetic material precipitated on the magnetic recording medium starting from the substrate of the composition (B). Uniform deposition of Fe is again well observed.

FIG. 3 shows the state of magnetic material precipitated on the magnetic recording medium starting from the substrate of the composition (C) which does not include Cr and Zn. In this case crystal orientation in the left half is different from that in the right half. A great difference in density of Fe deposition is clearly observed.

Figure 4:
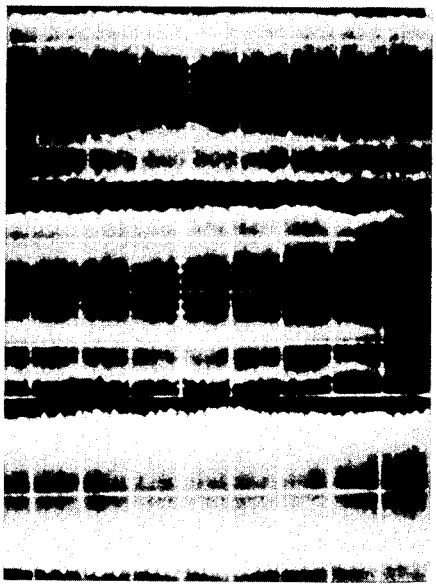
FIG. 4 is a oscilloscopic representations of the output envelopes from the magnetic recording media obtained in the examples.

Output envelopes from the three samples were measured to make clear fluctuation in output level per one cycle of track, and the results are shown in FIG. 4. The upper wave is for the sample of the composition (A), the middle for the composition (B) and the lower for the composition (C).

It is clear from this photographical representation that the wave of the sample of the composition (A) includes very little change in level and even undulation is least observed. The output level includes minimum fluctuation. The wave of the sample of the composition (B) also includes little change in level though slight undulation is observed. As is well known, undulation can be electrically removed by properly designing magnetic recording devices and, as a consequence, presence of such undulation poses no serious influence on magnetic recording. In contrast to this, change in level of short period results in generation of harsh noise at magnetic reproduction. So, the less is short change in level, the better is the result of magnetic recording. It is clearly observed that the sample of the composition (C) presents significant change in level whilst including negligible extent of undulation.

In accordance with the present invention, additional inclusion of specified amount of Cr and/or Zn removes malign influence crystal orientation on the electric characteristics of the barrier layer in the anode oxidized film, thereby assuring uniform deposition of magnetic material at electrolytic precipitation. As a consequence, a resultant magnetic recording medium presents very little change in output level, thereby greatly eliminating noise problem.

I claim:

1. An improved substrate for magnetic recording media comprising 0.03 to 0.05% by weight of Cr, 0.001 to 0.002% by weight of Zn and Al in balance.

2. The improved substrate as claimed in claim 1 further comprising 3.5 to 4.5% by weight of Mg.

3. A magnetic recording device having as a base material an improved substrate comprising 0.03 to 0.05% by weight of Cr, 0.001 to 0.002% by weight of Zn, and Al in balance.

4. The magnetic recording device according to claim 3 further comprising 3.5 to 4.5% by weight of Mg.

* * * * *